US005224629A

United States Patent [19]

Hsich

[11] Patent Number: 5,224,629

[45] Date of Patent: Jul. 6, 1993

[54] CONTROL STRUCTURE FOR A PNEUMATIC SEALANT GUN

[76] Inventor: Rong-Fuh Hsich, P.O. Box 96-405, Taipei 10098, Taiwan

[21] Appl. No.: 853,955

[22] Filed: Mar. 19, 1992

[51] Int. Cl.[5] ..... B67D 5/52

[52] U.S. Cl. ..... 222/137; 222/145; 222/334; 222/397

[58] Field of Search ..... 222/135-137, 222/145, 389, 397, 459, 334

[56] References Cited

U.S. PATENT DOCUMENTS

| | | | |
|---|---|---|---|
| 3,980,209 | 9/1976 | Collar | 222/389 X |
| 4,376,498 | 3/1983 | Davis, Jr. | 222/389 X |
| 4,676,410 | 6/1987 | von Flue | 222/389 X |
| 4,925,061 | 5/1990 | Jeromson, Jr. et al. | 222/397 X |
| 4,932,094 | 6/1990 | McCowin | 222/389 X |
| 5,020,693 | 6/1991 | Ernst et al. | 222/389 X |
| 5,058,769 | 10/1991 | Kurtz | 222/389 X |
| 5,064,098 | 11/1991 | Hutter, III et al. | 222/389 X |

FOREIGN PATENT DOCUMENTS

| | | | |
|---|---|---|---|
| 0331942 | 9/1989 | European Pat. Off. | 222/145 |

*Primary Examiner*—Gregory L. Huson

[57] ABSTRACT

A control structure for a pneumatic sealant gun, which comprises a handle and a sizing assembly; both of them are able to be assembled together in a detachable manner so as to adapt to different type of sizing assembly. Both front and rear hoods of the cylinder of the sizing assembly are mounted with two connectors respectively; each connector is then connected to a connector on the rear side of a valve switch in the handle. The cylinder includes a piston therein with a guide shaft extended to the front hood. The handle is furnished with an air-supply trigger assembly to control the intake and exhaust of the sizing assembly of the pneumatic sealant gun.

8 Claims, 5 Drawing Sheets

CONTROL STRUCTURE FOR A PNEUMATIC SEALANT GUN

BACKGROUND OF THE INVENTION

1. Field of the Invention

This invention relates to a pneumatic sealant gun, and particularly to a changeable sizing assembly and a control assembly for the intake/exhaust of the sizing assembly.

2. Description of the Prior Art

The current sealant is usually made of silicone or epoxy; the silicone sealant is usually loaded in a cylindrical tube; the sealant made of epoxy includes a primary agent and a hardening agent, which are loaded in two cylindrical tubes respectively, being mixed up via a mixing tube before use. The main tube loaded with such sealant is mounted on a connecting base in front of a sealant gun; the sealant can be extruded out of the gun upon the gun trigger being pulled. Such a sealant gun has a very low working efficiency. Another kind of sealant gun has a control assembly to control a compressed air as a pushing force to extrude a sealant in a tube mounted in the front end of the gun. The control assembly includes a trigger, whereby the control function is to be performed. In the conventional sealant gun, a one-way air-supply assembly is used, and controlled with a trigger. Since there is no exhaust function in such a gun, a given volume of compressed air would be left in the gun after the trigger being released; as a result, the sealant in the sealant tube would be extruded out continuously before the residual compressed air being released completely; the aforesaid condition of a conventional sealant gun is deemed a drawback; Moreover, since the handle and the sealant tube of such a sealant gun are usually formed integrally into one piece, the handle is unable to be used for different types of sealant guns, if necessary.

SUMMARY OF THE INVENTION

This invention provides a pneumatic sealant gun, of which the features are that the upper end of the handle thereof has a connecting mortise to be mated with a connecting tenon under a connecting base, on which a main tube is mounted. By means of the connecting tenon and ducts, a different sealant and sealant tube can be adapted to one handle of the sealant gun according to the present invention, and such features can also facilitate the sealant gun to be in a storage condition.

Another feature of the present invention is that the handle has an intake connector and an intake regulating valve for adjusting the pressure of an intake air to enter the sealant gun. The upper part of the handle has an air-supply trigger assembly to control ON/OFF of a compressed air. The upper end of the handle has a valve switch, which is connected with two ducts to be connected with the front end and the rear end of a sizing assembly; the valve switch is used for controlling a piston in the sizing assembly to move back and forth.

Still another feature of the present invention is that the valve switch is in communication with the air-supply trigger assembly via an intake passage; the valve switch is fixed in the handle by means of a bush member. The rear side of the handle is furnished with two symmetrical screw holes for receiving two connectors respectively; one side of the valve switch is furnished with two symmetrical exhaust holes. The valve seat in the bush member is mounted with a valve stem able to move laterally; the valve stem has two symmetrical ring-shaped grooves, which can have a compressed air flowed into different connector upon being switched at a position so as to supply the compressed at position so as to supply the compressed air to the sizing assembly, and drive the piston to move in a direction desired.

A further feature of the present invention is that both ends of the cylinder in the sizing assembly are mounted with a rear and a front hood respectively; each of the hoods is connected with a connector; each connector is connected with a duct that is connected with one connector on the valve switch. The cylinder is mounted with a piston, which has at least one guide shaft; the front end of the guide shaft passes the front hood and is mounted with a push disk.

A connecting base is mounted in the front part of the front hood for fastening a main tube. The connectors on the front and rear hoods are connected with the valve switch; when the valve switch is operated, the piston will move back and forth in opposite direction.

A still further feature of the present invention is that the connecting base in the front end of the sizing assembly is used for mounting a main tube; when the valve switch is operated, the piston in the cylinder will move back and forth in opposite direction. When the trigger is released, the air pressure in the sizing assembly will be removed as a result of the exhaust member in the air-supply trigger assembly; therefore, the sealant in the mixing tube would not be extruded out continuously.

A yet further feature of the present invention is that the valve switch in the handle has two symmetrical exhaust holes being in communication with the bush member. When the valve stem is pushed to move laterally, only one of the connectors being connected with the sizing assembly can supply a compressed air.

DETAILED DESCRIPTION OF THE PREFERRED EMBODIMENT

Figure 1:
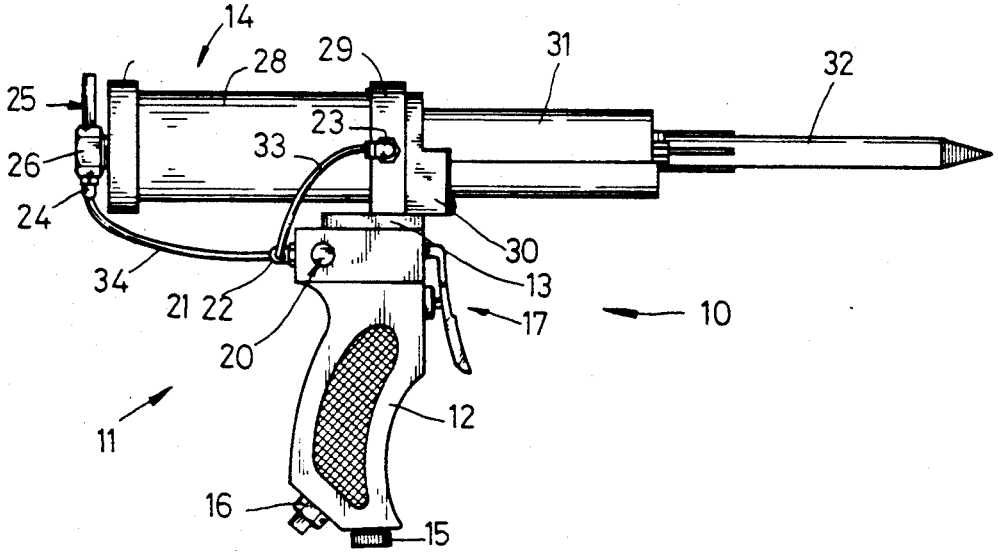
FIG. 1 is a side view of an embodiment of a pneumatic sealant gun according to the present invention.

This invention relates to a control structure of a pneumatic sealant gun for applying a sealant in current construction work; the sealant may be a silicone sealant to be filled in a cylindrical tube, or an epoxy resin made of a primary agent and a hardening agent to be loaded in two cylindrical tubes respectively which are mounted in a main tube. A pneumatic gun assembly is detachably mounted in place for injecting the sealant. FIG. 1 is a side view of a pneumatic sealant gun 10, which comprises a handle 12; the lower end of the handle 12 has an intake regulating valve 15 and an intake connector 16. The intake connector 16 is connected with an air compressor by means of a tube, and the intake regulating valve 15 is used for regulating the air volume entering the intake connector 16. An air-supply trigger assembly 17 mounted on the upper part of the handle 12 is in communication with the intake connector 16 through an intake passage so as to control the ON/OFF of a compressed air. The handle 12 is mounted with a valve switch 20, whereby the compressed air can flow, through the duct 33 or duct 34, into a front hood 29 or a rear hood 27 of a sizing assembly 14 as a thrust force inside a main tube 31 to push a sealant therein to inject outwards through a mixing tube 32 for a given sizing work.

Figure 2:
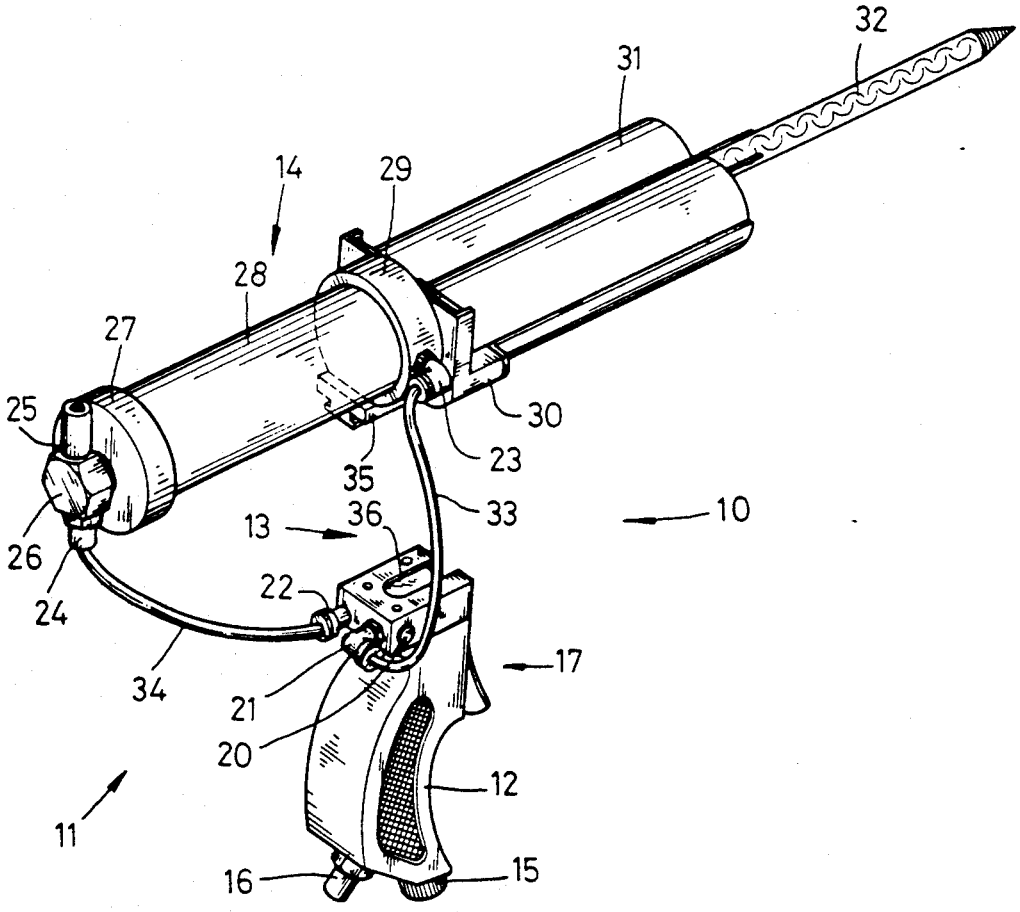
FIG. 2 is a perspective and fragmental disassemble view of the pneumatic sealant gun of the present invention.

As shown in FIG. 2, the top of the handle 12 has a connecting mortise 36, which is to be mated with a connecting tenon 35 under the front hood 29 of the sizing assembly 14 so as to connect the sizing assembly 14 and the handle 12 together; however, the sizing assembly 14 and the handle 12 may also be fastened together by means of screws. The connecting tenon 35 and the connecting mortise 36 are referred to as a connecting assembly 13. The aforesaid connecting assembly can facilitate using different sealant or different type of main tube 31, if necessary; in that case, another main tube 31 can be mounted on the front end of the sizing assembly 14 before the same being fastened together with the handle 12 and the ducts being connected for a sizing work.

In order to facilitate the sizing work, the pneumatic sealant gun 10 has a control assembly 11 mounted between the handle 12 and the sizing assembly 14 as shown in FIGS. 1 to 3 and 7; the control assembly 11 includes an air-supply trigger assembly 17 and a valve switch 20. The lower end of handle 12 has two screw holes 42 and 37, which are in communication with each other through an air passage 41. The screw hole 42 is mounted with an intake connector 16 which is further connected with an air compressor; the intake connector 16 is mounted in the screw hole 42 by means of a washer groove and washer 57 in an air-tight manner. The screw hole 37 is mounted with an intake regulating valve 15, around which a washer groove and washer 38 is mounted for air-tight connection. In the screw hole 37, there is a valve surface 40; when the knob 39 is turned, the space between the front end of the intake regulating valve 15 and the air passage 41 will be varied so as to adjust the air taken in.

Figure 5:
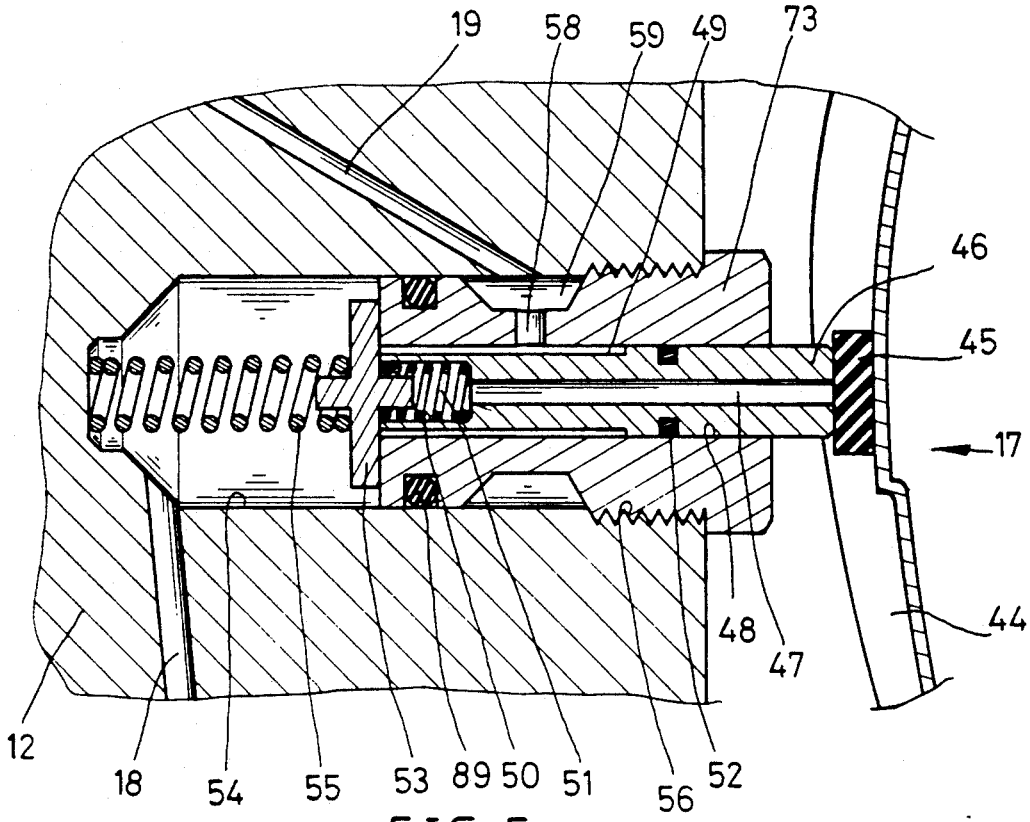
FIG. 5 is an enlarged section view of the air-supply trigger assembly in the handle of the pneumatic sealant gun according to the present invention.
Figure 6:
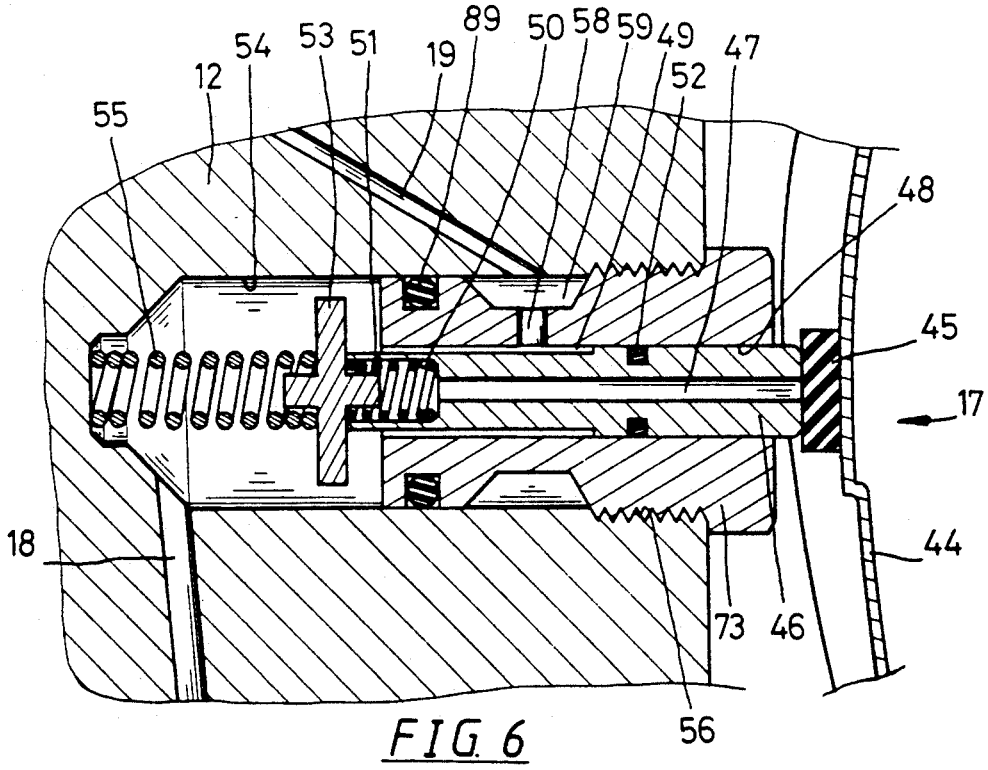
FIG. 6 is an enlarged section view of the air-supply trigger assembly in the handle of the pneumatic sealant gun according to the present invention, showing the air-supply state of the trigger assembly.

When air is supplied from the lower end of handle 12, the air will flow through the intake passage 18 to a valve base hole 54 in the air-supply trigger assembly 17. As shown in FIGS. 5 and 6, the external end of the valve base hole 54 has a screw hole 56, for fastening a valve seat 73, which is connected with the valve base hole 54 in air-tight condition by means of a washer groove and washer 89. The valve seat 73 has a valve stem hole 48 and a ring-shaped groove 59. A through hole 58 is furnished between the valve stem hole 48 and the ring-shaped groove 59. A valve stem 46 is fitted in the valve stem hole 48. When the trigger 44 is pushed, the valve stem 46 will move inwards at a given distance. The axial part of the valve stem 46 has an air-exhaust hole 47, of which the inner end has a cylindrical hole 50 for receiving a spring 51. The inner part of the valve seat 73 has a minor diameter portion 49. The central portion of the valve stem 46 has a washer groove and washer 52 so as to provide a close contact between the valve stem 46 and the valve stem hole 48. The inner end of the valve seat 73 provides a function of turning ON/-OFF of a compressed air flowing through the intake passage 18. The inner end of the valve seat 73 is fitted with a valve disk 53, of which one side facing the valve seat 73 has a short stud, being mounted with a spring 51; one end of the spring 51 is seated in the cylindrical hole 50. The other side of the valve disk 53 also has a short stud mounted with a spring 55, of whivh the other end is seated against the end of the valve base hole 54.

When the air-supply trigger assembly 17 is set in closed condition, and a compressed air enters the valve base hole 54 through the intake passage 18, the compressed air will press the valve disk 53 in close contact with the inner end of the valve seat 73; in that case, the compressed air is unable to enter the intake passage 19 via the air-supply trigger assembly 17. When the trigger 44 of the air-supply trigger assembly 17 is pushed inwards to cause the valve stem 46 to move, a leak-proof washer 45 mounted between the trigger 44 and the valve stem 46 will close the air-exhaust hole 47 in the valve stem 46; at the same time, the valve stem 46 will cause the valve disk 53 to move inwards; then, a compressed air can flow through the space between the valve stem hole 48 of the valve seat 73 and the minor diameter portion 49 of the valve stem 46, the through hole 58, the ring-shaped groove 59 and the intake passage 19.

As soon as the trigger 44 is released by a user, the valve disk 53 in the valve base hole 54 will be pushed back by the spring 55 to be in close contact with the inner end of the valve seat 73; in that case, the compressed air is turned off, i.e., the compressed air inside the sizing assembly 14 is removed as a result of the spring 51 in the cylindrical hole 50 and a spring 90 to push the trigger 44 back to its normal position, and then the leak-proof washer 45 will not be in close contact with the opening end of the valve stem 46. Since the spring 51 is pushing the valve stem 46 to move outwards, the compressed air will be exhausted through the space formed between the minor diameter portion 49 and the valve stem hole 48 and the air-exhaust hole 47.

Figure 3:
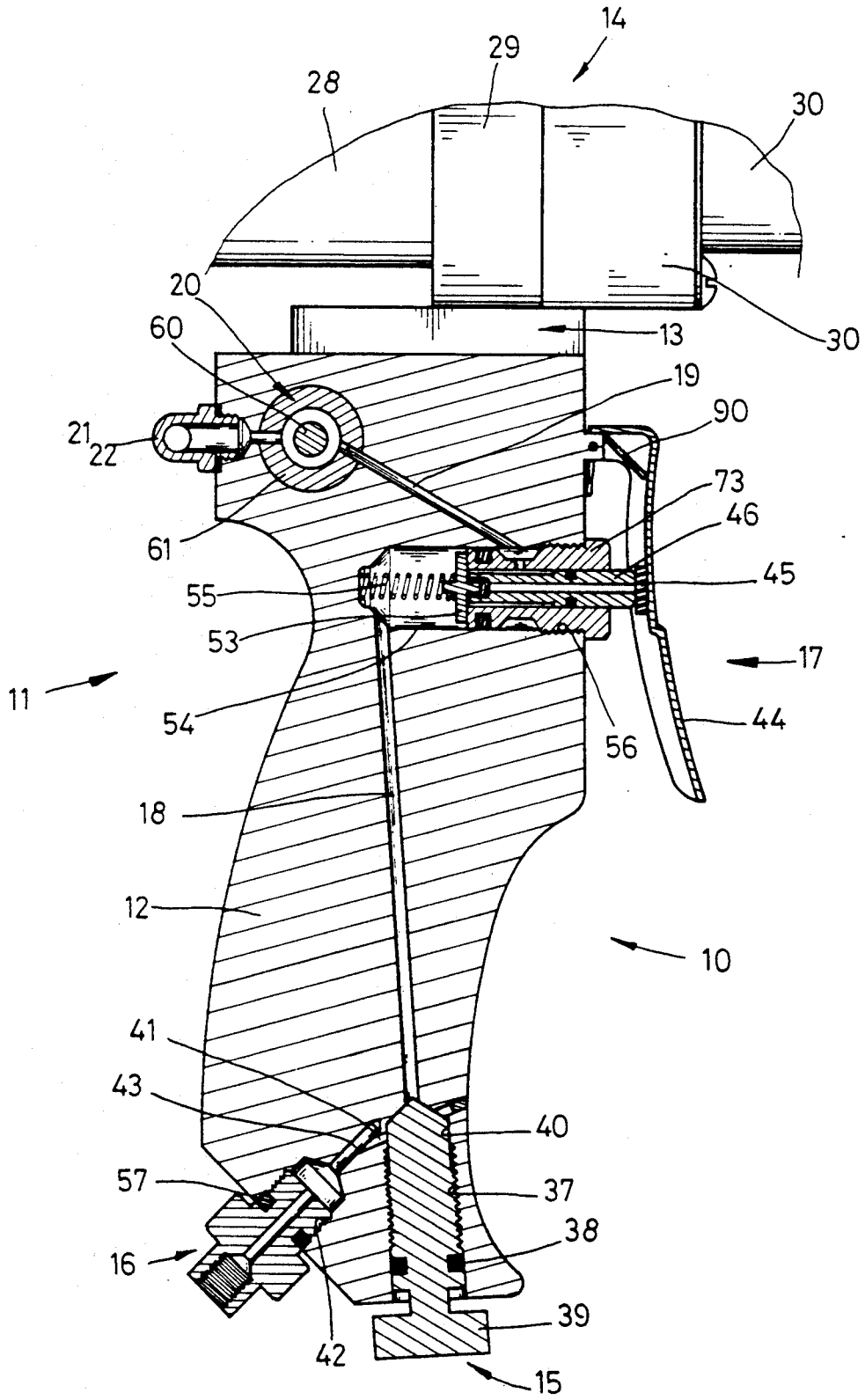
FIG. 3 is a sectional view of the handle assembly of the pneumatic sealant gun according to the present invention.
Figure 7:
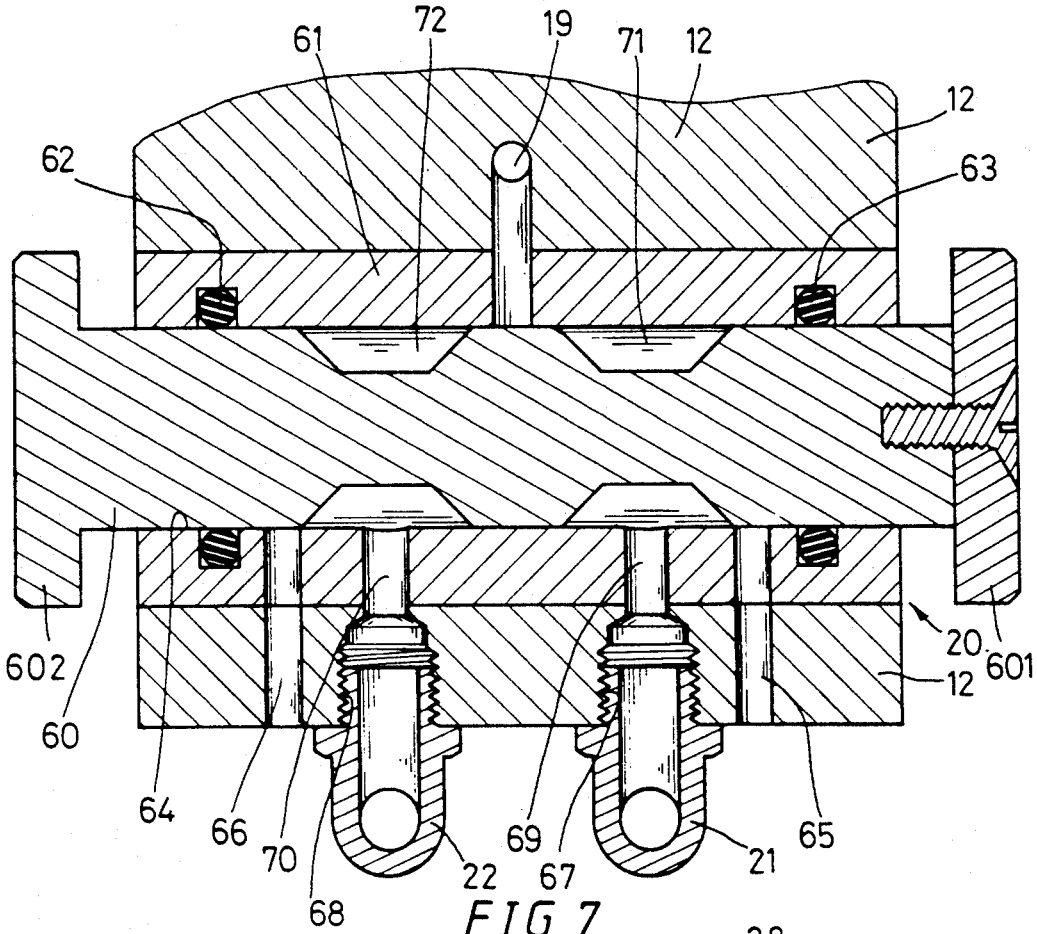
FIG. 7 is a sectional view of a valve switch in the handle of the pneumatic sealant gun according to the present invention.

When the air-supplying trigger assembly 17 is turned on, the compressed air will flow through the intake passage 19 to the valve switch 20; as shown in FIGS. 2, 3 and 7, the valve switch 20 includes a bush member 61, and a valve seat 64; the valve seat 64 and the intake passage 19 are in communication with each other by means of a through hole. Each end of the bush member 61 has a washer groove and washer 62(or 63) to provide a leak-proof function between the valve stem 60 and the bush member 61. The rear side of the handle 12 has two screw holes 67 and 68 for mounting two connectors 21 and 22 respectively, which may be a straight type or elbow type connector. The two connectors 21 and 22 are connected with two ducts 33 and 34 respectively, while the other ends of the two ducts are connected with two points respectively on the sizing assembly 14. The two screw holes 67 and 68 corresponding to the two connectors 21 and 22 are aligned with two air passages 69 and 70 respectively in the bush member 61, being in communication with the valve seat 64. Beside the two air passage 69 and 70, there are two exhaust holes 65 and 66 furnished in the handle 12 for the purpose of exhausting air at one end of the sizing assembly 14 upon the valve stem 60 being switched to one end. Bath ends of the valve stem 60 have two positioning knobs 601, 602 respectively to be used for placing the valve stem 60 at a position desired. The valve stem 60 is furnished with two symmetrical ring-shaped grooves 71 and 72, whereby a compressed air from the intake passage 19 can enter one of the screw holes 67 and 68, and can flow into the sizing assembly 14 via duct 33 or 34.

When the valve switch 20 is switched to a position to have a compressed air from the intake passage 19 flowed through the ring-shaped groove 72 and the air passage 70, the compressed air will flow, through the connector 22 and the duct 34, into the rear connector 24 of the sizing assembly 14; the assembly 14 will apply a pressure to the main tube 31 to function as expected. When the valve switch 20 is switched to a position to a compressed air from the intake passage 19 flowed through the ring-shaped groove 71 and the air passage 69, the compressed air will flow, through the connector 21 and the duct 33, into front connector 23 of the sizing assembly 14; in that case, the compressed air in the sizing assembly 14 will function in opposite direction. Simultaneously, if the compressed air in the rear connector 24 is not released, the compressed air flowed into the sizing assembly 14 via the front connector 23 would not work. Therefore, the outer portion of the valve switch 20 is furnished with two symmetrical exhaust holes 65 and 66. If the compressed air deposited in the sizing assembly 14 via the rear connector 24 is exhausted via the air passage 70, the ring-shaped groove 72 and the exhaust hole 66 upon the valve stem 60 being switched in place, the compressed air entered via the front connector 23 can work normally.

Figure 4:
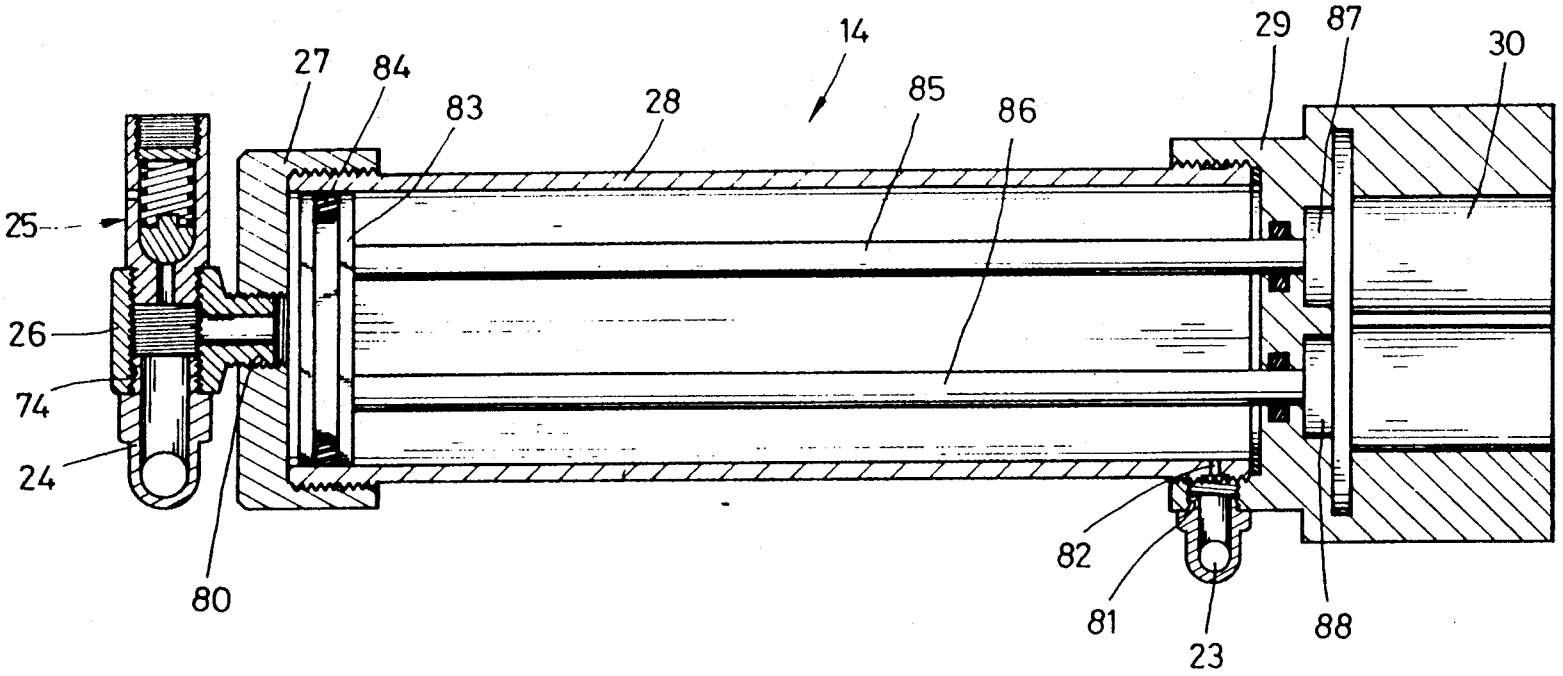
FIG. 4 is a cross-sectional view of the sizing assembly of the pneumatic sealant gun according to the present invention.

Therefore, the valve sewitch 20 can guide a compressed air into the duct 33 or 34 to provide two function force in two opposite directions; as shown in FIGS. 2 and 4, the sizing assembly 14 includes a cylinder 28 with a piston 83 therein. The piston 83 can move back and forth in air-tight manner by means of a washer groove and washer 84. The rear end of the piston 28 is mounted with a rear hood 27, of which the center or a suitable point is provided with a screw hole 80 for mounting a T-shaped connector 26. To prevent the compressed air entered the rear connector 24 from exceeding a given tolerance, the T-ahaped connector 26 is furnished with a screw hole 74, of which one end is mounted with a release valve 25, while the other end thereof is mounted with the rear connector 24; the release valve 25 is used for releasing any exceeding pressure of the compressed air. The rear hood 27 has a screw hole 80, in which the rear connector 24 can directly be mounted; the release valve 25 may be mounted in a screw hole 48 in the handle 12.

The other end of the cylinder 28 in the sizing assembly 14 is mounted with a front hood 29, which has a screw hole 81 to connect with the front connector 23 so as to let a compressed air enter to pull the piston 83 back to its original position. In order to facilitate a compressed air to enter the cylinder 28, the screw hole 81 to be connected with the front connector 23 has a ring-shaped recess with a through hole 82.

The piston 83 inside the cylinder 28 has at least one guide shaft fastened to one end thereof; as shown in FIG. 4, the piston is fastened with two guide shafts 85 and 86, whereby a main tube 31 filled with a primary agent and a hardening agent can be mounted to a connecting base 30. The front ends of the two guide shafts 85 and 86 are mounted with two push disks 87 and 88 respectively. As soon as a compressed air enters the rear connector 24, the two push disks 87 and 88 will be pushed forwards into the main tube 31 having two cylindrical tube so as to have the two agents as mentioned above mixed up in a mixing tube 32 and injected out for a sizing work. Of course, the piston 83 may be mounted with a single guide shaft with one push disk, and the connecting base 30 has only one groove to mount a single main tube 31 to perform a sizing work.

Figure 8:
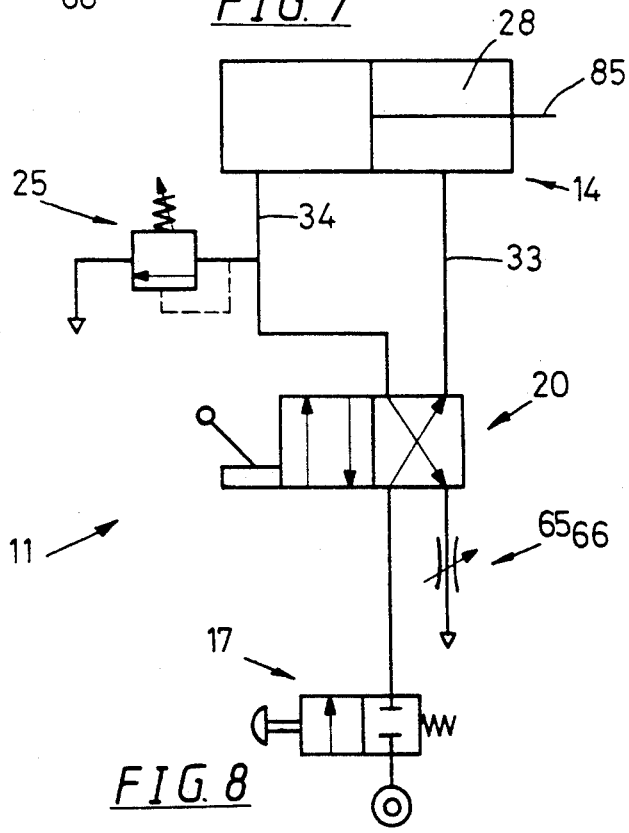
FIG. 8 is a control loop diagram of the pneumatic sealant gun of the present invention.

The control assembly of the present invention has a control circuit as shown in FIGS. 2 and 8; as soon as a compressed air enters the intake connector 16, the air will be regulated at a suitable pressure; then, the compressed air flows through the air-supply trigger assembly 17, and into the sizing assembly 14. By means of the valve switch 20, the compressed air in the sizing assembly 14 can push the piston therein to move back and forth. When the valve switch 20 is switching, the compressed air in opposite direction can be exhausted directly and automatically so as to facilitate the main tube 31 to perform a compression and mixing function, which is necessary to a sizing work.

According to the aforesaid embodiment, the present invention has effectively improved the conventional pneumatic sealant gun by means of a novel structure thereof. Of course, any modification made to the embodiment of the present invention by a person skilled in the art should be construed as within the concept scope of the claims of this application.

I claim:

1. A control structure for a pneumatic sealant gun comprising:

a handle with an air-supply trigger assembly having a valve base hole being in communication with an intake passage, and one end of said intake passage being in communication with an air passage of an intake connector; an outer end of said valve base hole having a screw hole for receiving a valve seat, of which the center has a valve stem hole for receiving a valve stem; a valve disk being mounted near the inner end of said valve seat, and said valve disk having two short studs extended in opposite direction to each other; said two short studs each being mounted with a spring; and said valve stem having an air-exhaust hole in the center thereof; said valve stem having a minor diameter portion nearing said valve disk; and said valve seat having a ring-shaped groove with a through hole in communication with said valve stem hole; said ring-shaped groove being in communication with a valve switch via an intake passage;

said valve switch being mounted on said handle by means of a bush member, in which a valve seat is mounted for receiving a valve stem; said valve seat having two symmetrical washer grooves and washers near the outer ends thereof; said valve stem having two symmetrical ring-shaped grooves; and said bush member having a through hole in communication with an intake passage of said air-supply trigger assembly; and a rear side of said handle having two screw holes for mounting two connectors are aligned with two air passages respectively in the bush member, being in communication with the valve seat; and said two connectors are connected with two ducts respectively, while the other ends of the two ducts are connected with two points respectively on the sizing assembly; the outer portion of said two air passages are furnished with two symmetrical exhaust holes;

a sizing assembly on said handle including a cylinder with a front hood and a rear hood; and said rear hood having a screw hole for mounting a rear connector, and said front hood having screw hole for mounting a front connector; said cylinder having a piston with at least one guide shaft having a push disk mounted on one end thereof near a connecting base; and said front connector on said front hood being connected with a connector on said valve switch through a duct; and said rear connector on said rear hood being connected with a connector on said valve switch through a duct.

2. A control structure for a pneumatic sealant gun as claimed in claim 1, wherein the upper end of said handle has a connecting mortise to be mated with a connecting tenon under a connecting base of said front hood so as to have said sizing assembly and said handle fastened together.

3. A control structure for a pneumatic sealant gun as claimed in claim 1, wherein a front end of said cylinder in said sizing assembly is mounted with a connecting base for mounting a single main tube; and said cylinder having a piston with one guide shaft fastened in the center thereof.

4. A control structure for a pneumatic sealant gun as claimed in claim 1, wherein a front end of said cylinder in said sizing assembly has a main tube with two cylindrical tubes; and a piston in said cylinder being mounted with two guide shafts on one side thereof facing said front hood.

5. A control structure for a pneumatic sealant gun comprising a sizing assembly on the upper end of a handle of said pneumatic sealant gun, a front end of said sizing assembly being mounted with a connecting base for a main tube having two cylindrical tubes; and said sizing assembly including:

a cylinder having a cylindrical inner surface; and one end of said cylinder having outer threads for mounting a rear hood, while the other end of said cylinder has outer threads with a ring-shaped recess and a through hole for mounting a front hood thereon;

said front hood being mounted on said cylinder, and said front hood having a connecting base for attaching a main tube; and said front hood having a screw hole being connected with a front connector;

a piston mounted inside said cylinder, and said piston having a washer groove and washer to be in close contact with said inner surface of said cylinder; and on one side of said piston facing said front hood being mounted two guide shafts, of which front ends are mounted with two push disks respectively nearing said connecting base.

6. A control structure for a pneumatic sealant gun as claimed in claim 5, wherein a front end of said cylinder is mounted with a connecting base, which is formed integrally with said front hood as one piece.

7. A control structure for a pneumatic sealant gun as claimed in claim 5, wherein a front end of said cylinder has a connecting base and a front hood, which are two members to be assembled together.

8. A control structure for a pneumatic sealant gun comprising a handle as an intake and exhaust member, and a sizing assembly mounted on said handle; and said handle having a valve base hole for receiving an air-supply trigger assembly which includes:

a valve seat having a valve hole for fitting a valve stem, an outer end of said valve seat having outer threads whereby said valve seat is fastened in said valve base hole by complementary threads; another end of said valve seat having a washer groove and washer; a ring-shaped groove being furnished between said washer groove and washer and said outer threads, and said ring-shaped groove being in communication with said valve stem via a through hole;

said valve stem being mounted in said valve stem hole, and having a cylindrical hole in one end of said valve stem; said cylindrical hole having an air-exhaust hole extended through another end of said valve stem; said cylindrical hole in said valve stem facing an inner end of said valve base hole, and being loaded with a spring, of which one end is in contact with a valve disk, and having a minor diameter portion in said valve stem facing an inner end of said valve base hole, and said minor portion in communication with a through hole in said valve seat; and said valve disk having two short studs on both sides thereof respectively, and each of said studs being mounted with a spring; and said one valve stem spring being in contact against said valve stem in said valve stem hole; and the other said spring on one said short stud being in close contact with one end of said valve base hole.

* * * * *